United States Patent [19]

Lawrence

[11] 4,403,725

[45] Sep. 13, 1983

[54] NAIL HOLDING AND DIRECTING DEVICE

[76] Inventor: Noel A. Lawrence, 5980 Bienville, Brossard, Quebec, Canada

[21] Appl. No.: 241,009

[22] Filed: Mar. 6, 1981

[51] Int. Cl.[3] ..... B25C 3/00; B25C 9/00

[52] U.S. Cl. ..... 227/147; 145/46

[58] Field of Search ..... 145/46, 52; 269/2; 227/147; 81/453, 454, 455

[56] References Cited

U.S. PATENT DOCUMENTS

| | | | |
|---|---|---|---|
| 535,503 | 3/1895 | Kornder | 227/147 |
| 953,434 | 3/1910 | Northam | 81/438 |
| 1,152,260 | 8/1915 | Anderson | 227/147 |
| 2,205,167 | 6/1940 | Greterman | 85/455 |
| 2,902,690 | 9/1959 | Hamlin | 227/147 |
| 3,060,441 | 10/1962 | Henning | 227/147 |
| 3,901,298 | 8/1975 | Eby | 145/46 |
| 4,179,058 | 12/1979 | Yost | 227/147 |

FOREIGN PATENT DOCUMENTS

| | | | |
|---|---|---|---|
| 730561 | 5/1980 | U.S.S.R. | 81/454 |

*Primary Examiner*—Roscoe V. Parker

*Attorney, Agent, or Firm*—Swabey, Mitchell, Houle, Marcoux & Sher

[57] ABSTRACT

The disclosure is concerned with a nail holding and directing device comprising a handle and an elongated member connected to the handle and having a longitudinally extending bore into which an end portion of the nail may be coaxially inserted at one end of the member. A striker rod is slidably mounted in the bore for reciprocating movement therein; the rod has an outer end extending beyond the other end of the member and an inner end adapted to abut against the end portion of the nail. Gripping fingers are mounted at the aforesaid one end of the member and are operable selectively between open and closed positions so as to respectively release and slidably hold the nail between its ends while guiding same when a striking force is applied to the outer end of the striker rod for forcing the nail out of the bore and into a structure. The device further includes a spring normally urging the gripping fingers towards the closed position, as well as actuating structure operatively connected to the gripping fingers for moving same to the open position against the closing force of the spring. The nail holding and directing device permits a nail to gain access to confining locations and still be accurately directed into a structure at such locations. By eliminating the heretofore requirement of holding a nail between one's fingers, the injuries caused to the finger tips by inadvertent hammer blows are also eliminated.

10 Claims, 7 Drawing Figures

58
60
102
22
24
26
80
76
82
66
70
84
6
128
20
72
86
62
90
96
98'
4
5
52
112
28
106
110
108
46
94
92
18
78
74
16
68
34
124
116
118
14
32
122
120
88
64
104
100
38

100
98'
3
98
86
28
96
20
16
18

28
106
110
136
46

70
76
16
18
128
128'
126
126'
130
130'
124
124'
116
116'
34
118
118'
38
120
32

58
B
A
12
20
126
16
86
102
98'
96
92
112
110
104
136
28
106
134
94
62
114
18
100
34
124
116
38
118
120
132
122
32
60

NAIL HOLDING AND DIRECTING DEVICE

FIELD OF THE INVENTION

This invention relates to a nail holding and directing device and, more particularly, to a device for directing nails into a structure at locations which are generally inacessible when the nail is held between one's fingers.

It is often necessary for a carpenter or other person to hammer nails into a structure near or at narrow corners, for instance, when fixing a wall molding adjacent a floor or ceiling at the intersection of two walls. In such corners, the hand as well as the fingers which hold the nail hinder the accurate positioning of the nail and also the hammering action of the hammer, particularly when using finishing nails which are of short lengths and are thus difficult to hold between the fingers and yet permit exposure of the nail head for hammering. As a result, the nail will most often be misdirected into the structure or the persons's finger tips will suffer from inadvertent hammer blows which may also damage surrounding valuable finishing pieces. The same also applies when directing nails of such type into inaccessible recesses.

It is also desirable when performing delicate finishing work to accurately direct the nail into the finishing piece for if the nail is misdirected by an inadvertent displacement of the fingers, the nail must be removed thereby leaving a hole in the finishing material which will require replenishing. The replenished hole often will require the further steps of color matching and buffing so as to restore the original finish, thus involving the consumption of additional time and efforts.

SUMMARY OF THE INVENTION

Accordingly, it is an object of the present invention to overcome the above drawbacks and to provide a nail holding and directing device which will eliminate the heretofore requirement of holding a nail between one's fingers and permit the nail to gain access to confining locations and still be accurately directed into a structure at such locations.

In accordance with the invention, there is provided a nail holding and directing device comprising a handle and an elongated member connected to the handle and having a longitudinally extending bore into which an end portion of the nail may be coaxially inserted at one end of the member. A striker rod is slidably mounted in the bore for reciprocating movement therein; the rod has an outer end extending beyond the other end of the member and an inner end adapted to abut against the end portion of the nail. Gripping means are mounted at the aforesaid one end of the member and are operable selectively between open and closed positions so as to respectively release and slidably hold the nail between its ends while guiding same when a striking force is applied to the outer end of the striker rod for forcing the nail out of the bore and into a structure. The device further includes biasing means normally urging the gripping means towards the closed position, as well as actuating means operatively connected to the gripping means for moving same to the open position against the closing force of the biasing means.

BRIEF DESCRIPTION OF THE DRAWINGS

A preferred embodiment of the invention will now be described with reference to an example thereof as illustrated in the accompanying drawings, wherein.

DESCRIPTION OF PREFERRED EMBODIMENT

Figure 1:
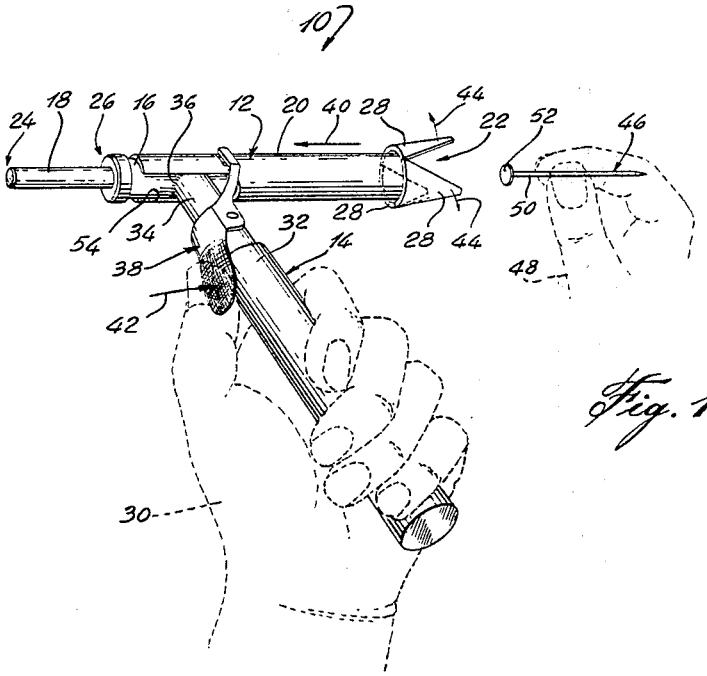
FIG. 1 is a perspective view showing a device according to the invention in position for loading with a nail.
Figure 2:
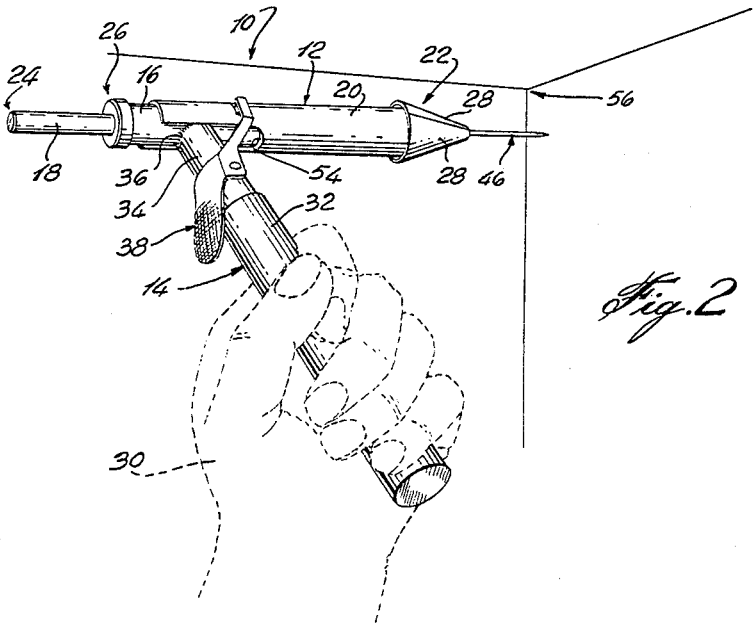
FIG. 2 is another perspective view showing the device of FIG. 1 with the nail loaded therein.

Referring first to FIGS. 1 and 2, the device illustrated and generally designated by reference numeral 10 is seen as having a T-shaped configuration and comprising a main elongated body 12 from which a handle 14 depends. The body 12 includes a bored cylindrical member 16 into which a striker rod 18 is slidably mounted for reciprocating movement, and a cylindrical sleeve 20 slidably mounted on the member 16 for axial movement towards and away from the front end 22 of the device, the sleeve 20 being normally urged forwardly by spring means (not shown). The outer end 24 of the striker rod 18 extends outwardly of the member 16 at the rear end 26 so that the striking force of a hammer may be applied thereto. Three identical part cone-shaped gripping fingers 28 are pivotally mounted at the front end 22 for pivotal movement between open and closed positions, the fingers 28 being normally urged to the closed position also by spring means (not shown).

The device 10 is hand-held by its handle 14 which is grasped by the fingers of one hand 30 shown in dotted lines; in order to permit a firm gripping of the handle by the hand, a coating 32 of rubber or soft plastic material is provided on a major portion thereof. The shank 34 of the handle is securely connected to the member 16 by means of soldering 36. An actuating member 38 is pivotally mounted on the handle shank 34 and is connected to sleeve 20 for axially displacing the sleeve rearwardly as indicated by the arrow 40 in FIG. 1, when it is actuated by the thumb of the hand in the direction indicated by the arrow 42.

As will be hereinafter described in detail, the rearward displacement of the sleeve 20 causes opening of the gripping fingers 28 as shown by the arrows 44, so as to permit the loading of the device with a nail 46 which is inserted by the fingers 48 (shown in dotted lines) of the other hand. Once the end portion 50 of the nail including its head 52 has been inserted, the actuating member 38 is released resulting in the forward displacement of the sleeve 20 and the closure of the gripping fingers 28 against the nail 46, the fingers holding the nail between its ends in chuck-like manner as shown in FIG. 2. The sleeve 20 has on its underside a cut-out portion 54 providing a clearance so as to prevent the handle shank 34 from hindering the axial displacement of the sleeve. The device 10 with the nail 46 loaded therein is thus ready for use in directing the nail into a structure at a confining location such as the corner represented by reference numeral 56 in FIG. 2.

Figure 3:
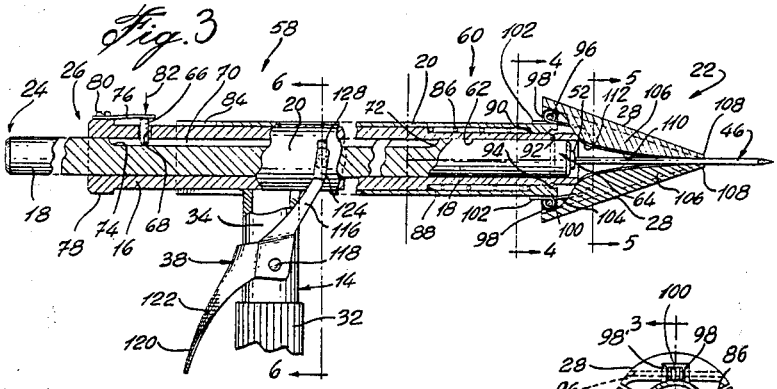
FIG. 3 is a part sectional view of the device illustrated in FIG. 2 with the gripping end thereof in closed position holding the nail.
Figure 4:
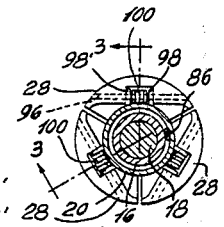
FIG. 4 is a cross-section taken along lines 4—4 of FIG. 3.

Turning now to FIG. 3, in which the portion 58 of the device illustrated at the left-hand side of the figure is a part vertical section while the portion 60 illustrated of the right-hand side is a section taken along lines 3—3 of FIG. 4, the striker rod 18 is seen slidably mounted into the cylindrical bore 62 of the member 16 and having its inner end 64 abutting against the head 52 of the nail 46 which is held by the gripping fingers 28. The reciprocating movement of the rod 18 within the bore 62 is limited by means of a pin 66 mounted adjacent the rear end 26, which projects through a hole 68 provided in member 16 and engages a groove 70 formed in the rod 18; the rearward displacement of the rod is limited when the pin 66 engages the front abutment surface 72 of the groove while the forward displacement is limited when the pin engages the rear abutment surface 74. Since the rod 18 is limited by the length of the groove 70, such length can be adjusted so that the inner end 64 will protrude through the fingers 28 beyond their respective tips 108 thereby enabling the rod 18 to serve also as a punch tool. The pin 66 is fixed to a leaf spring 76 secured to a flange 78 by means of a screw 80. The pin 66 is urged into frictional engagement with the groove 70 as a result of the force exerted by the spring 76 in the direction indicated by the arrow 82, so as to prevent any loose axial displacement of the rod 18 in bore 62. The sleeve 20 is provided at its rear end with a cut-out portion 84 defining a clearance so as to prevent the pin 66 from hindering the rearward displacement of the sleeve.

The sleeve 20 is normally urged forwardly by means of a compression spring 86 wound around the cylindrical member 16 and having its rear end bearing against an annular shoulder 88 on member 16 and its front end engaging an annular shoulder 90 in sleeve 20. The forward movement of sleeve 20 is limited by a circlip 92 mounted in a seat cut into member 16 and engaging a further annular shoulder 94 provided in sleeve 20 at its front end.

The gripping fingers 28 which are provided at the front end 22 slidably hold the nail 46 in substantially axial alignment with the central axis of the bore 62, while guiding the nail as it is being forced out of the bore and into a structure when the striking force of a hammer is applied to the outer end 24 of the rod 18 and transmitted to the nail head 52. Each finger 28 is mounted on a respective hinge pin 96 journalled in a respective pair of hinge sleeves 98 and 98' provided on the sleeve 20, for pivotal movement relative to sleeve 20. As best shown in FIG. 4, the three gripping fingers 28 are pivotally arranged equidistantly about the periphery of the sleeve 20. Although the device is shown as having three gripping fingers for a better gripping of the nail 46, it is quite apparent that only two such fingers could be used for achieving the same purpose, in which case the respective hinges would be located diammetrically opposite one another.

Each gripping finger 28 is normally urged to the closed position for holding the nail 46 by means of a respective torsion spring 100 wound around the respective hinge pin 96, between hinge sleeves 98 and 98'. Each torsion spring 100 has one free end 102 bearing against the sleeve 20 and the other free end 104 anchored in a respective inner central rib 106 of each finger 28.

Figure 5:
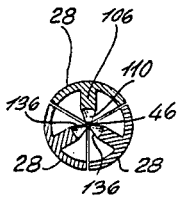
FIG. 5 is another cross-section taken along lines 5—5 of FIG. 3.
Figure 7:
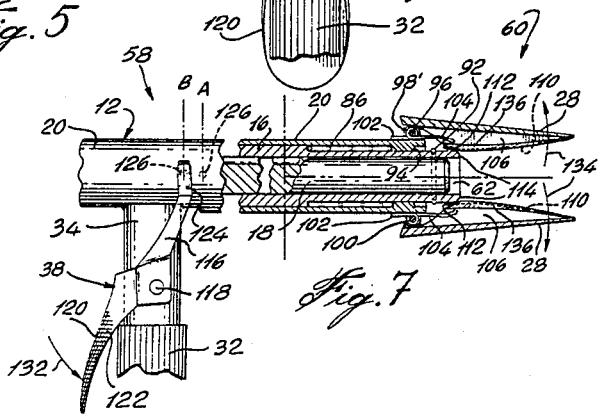
FIG. 7 is a view similar to that of FIG. 3 but showing the gripping end of the device in open position.

Each rib 106 tapers towards the respective tip 108 of each finger and is provided with a respective nail guiding inner concave surface 110, as best shown in FIG. 5. The nail guiding surface 110 extends along a major portion of rib 106 and also tapers towards the tip 108 so as to accommodate nails of different diameters. Each rib 106 is further provided adjacent the respective hinge of each finger 28 with a cam surface 112 for frictional engagement with the front end edge 114 of member 16 so as to cause each finger to pivotally move towards the open position against the closing force of the respective torsion spring 100, when the sleeve 20 is rearwardly displaced, as best illustrated in FIG. 7. Such opening of the gripping fingers 28 may be effected for the purpose of either loading the device with a nail or releasing a nail which has been driven partially but positively into a structure in order to permit the nail to be thereafter completely driven using directly a hammer or better still a punch tool. As already noted, however, it is possible to use the device as both a nail director and punch tool, in which case the gripping fingers 28 are not opened until the nail has been completely driven into the structure by the rod 18.

Figure 6:
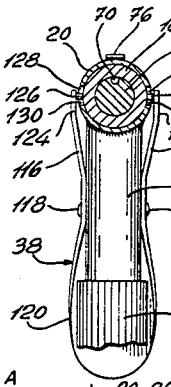
FIG. 6 is a further cross-section taken along lines 6—6 of FIG. 3.

In order to permit the sleeve 20 to be moved rearwardly and thus cause opening of the fingers 28, an actuating member 38 is provided which comprises a pair of opposed lever arms 116 and 116' pivotally mounted to the handle shank 34 by means of pivot pins 118 and 118' respectively, as best shown in FIG. 6. A finger-actuated element 120 having a knurled outer surface 122 is integrally connected to the arms 116 and 116' at their respective pivotal mountings. The lever arms have their free ends 124 and 124' straddling the sleeve 20 and movably connected thereto by means of respective inwardly projecting pins 126 and 126' which are inserted into respective slots 128 and 128' provided in sleeve 20, for limited displacement in the slots and for frictional engagement with respective inner sidewalls 130 and 130' of slots 128 and 128'.

Thus, as shown in FIG. 7, when the finger-actuated element 120 is pressed in the direction indicated by the arrow 132, the lever arms 116 and 116' are pivotally moved rearwardly with their respective connecting pins 126 and 126' being simultaneously displaced from position A to position B. Owing to the connecting pins 126 and 126' frictionally engaging the slot inner sidewalls 130 and 130' respectively, such displacement of the pins causes the sleeve 20 to move rearwardly against the forward force of compression spring 86, which rearward movement of the sleeve in turn causes the respective cam surface 112 of each finger 28 to frictionally engage the front end edge 114 of member 16 and to thereby ride thereover, resulting in the pivotal movement of each finger towards the open position as shown by the arrows 134 against the closing force of the respective torsion spring 100. Once the pressing ,force on the finger-actuated element is released, the lever arms 116 and 116' are pivotally moved forwardly with their respective connecting pins 126 and 126' being displaced back to position A owing to the forward force exerted on sleeve 20 by spring 86, which results in the automatic closure of each finger 28 by the closing force exerted thereon by its respective spring 100.

FIG. 7 also shows more clearly the anchoring of the free end 104 of each torsion spring 100 into the respective inner rib of each finger 28, as well as the side bevelled edges 136 of each rib 106.

Summarizing the operation of the device 10, the striker rod 18 is first partially retracted from the cylindrical member 16 at the rear end 26 so as to permit the bore 62 to accommodate at the front portion thereof the end portion 50 of the nail 46 including its head 52. The actuating member 38 is then actuated so as to cause the sleeve to move rearwardly and to thereby cause opening of the gripping fingers 28 in order to permit the end portion 50 of nail 46 to be coaxially inserted in the bore 62 with its head 52 abutting against the inner end 64 of rod 18. The actuating member 38 is thereafter released, resulting in the automatic closing of the gripping fingers 28 to slidably hold the nail 46 between its ends. In order to direct the nail 46 thus loaded in the device 10 into a structure, the striking force of a hammer is applied to the outer end 24 of rod 18 to move the rod forwardly and to thereby force the nail 46 out of the bore 62 and into the desired structure, while being guided at the same time by the gripping fingers 28. Due to the ramming action of rod 18 and the guiding effect of fingers 28, the possibilities of misdirecting the nail into the structure are greatly reduced. Once the nail has been driven partially but positively into the structure so as to be thereafter completely driven by the hammer or a punch tool, it is released by actuating the member 38 to cause opening of the gripping fingers 28. However, when it is desired to use the device itself also as a punch tool, the fingers 28 are allowed to remain closed until the nail has been completely driven into the structure by the rod 18.

The device 10 illustrated is compact and of light weight and thus may be easily carried in one's pocket. It is also simple in design and yet rugged, affording trouble-free operation and inexpensive manufacturing thereof.

I claim:

1. A nail holding and directing device comprising:

a handle;

an elongated member connected to said handle, said member having a longitudinally extending bore into which an end portion of said nail may be coaxially inserted at one end of said member;

a striker rod slidably mounted in said bore for reciprocating movement therein, said rod having an outer end extending beyond the other end of said member and an inner end adapted to abut against said end portion of said nail;

a sleeve slidably mounted on said member for movement towards and away from said one end of said member;

at least two gripping fingers each pivotally mounted on a respective hinge provided on one end of said sleeve adjacent said one end of said member, whereby said gripping fingers are pivotally movable relative to said sleeve between open and closed positions so as to respectively release and slidably hold said nail between its ends while guiding same when a striking force is applied to said outer end of said striker rod for forcing said nail out of said bore and into said structure, each said gripping finger being provided adjacent its respective hinge with a respective inner cam surface for frictional engagement with an end edge of said member at said one end thereof so as to cause each finger to pivotally move towards said open position when said sleeve is moved away from said one end of said member;

biasing means normally urging each said gripping finger towards said closed position;

further biasing means normally urging said sleeve towards said one end of said member;

stop means for preventing said sleeve from moving beyond said one end of said member;

a pair of opposed lever arms pivotally mounted on said handle for pivotal movement between first and second positions, said lever arms having the free ends thereof straddling said sleeve and connected thereto for moving said sleeve away from said one end of said member against the pushing force exerted by said further biasing means towards said one end when said lever arms are moved towards said second position, said lever arms being normally urged through said connection towards said first position by said further biasing means; and a finger actuated element connected to said lever arms for pivotally moving same towards said second position, thereby moving said sleeve away from said one end of said member and causing each said gripping finger to move to said open position against the closing force exerted by said biasing means.

2. The device as claimed in claim 1, wherein said gripping means comprise three of said gripping fingers pivotally arranged equidistantly about the periphery of said sleeve, whereby to hold said nail in chuck-like manner.

3. The device as claimed in claim 1, wherein said bore has a central axis and said gripping fingers are adapted to hold said nail in substantially axial alignment with said central axis.

4. The device as claimed in claim 1, wherein each gripping finger is provided at a respective tip portion thereof with a nail guiding inner surface.

5. The device as claimed in claim 4, wherein each gripping finger includes an inner longitudinally extending rib which tapers towards the tip of the finger and said nail guiding surface extends along a major portion of said rib and also tapers towards said tip so as to accommodate nails of different diameters.

6. The device as claimed in claim 1, wherein said biasing means comprises a torsion spring wound about the respective hinge of each gripping finger and having one free end engaging said sleeve and the other free end engaging each finger.

7. The device as claimed in claim 1, wherein said respective inner cam surface of each gripping finger is provided on an inner longitudinally extending rib which tapers towards the respective tip of each finger and has a nail guiding inner surface extending along a major portion thereof including a respective tip portion of each finger, said nail guiding surface also tapering towards the respective tip of each finger so as to accommodate nails of different diameters.

8. The device as claimed in claim 1, wherein said further biasing means comprise a compression spring wound about said member and having one end engaging said member and the other end engaging said sleeve.

9. The device as claimed in claim 1, wherein the respective free end of each lever arm is connected to said sleeve by means of an inwardly projecting pin inserted in a respective slot provided in said sleeve, for limited displacement in said slot and for frictional engagement with an inner sidewall of said slot.

10. The device as claimed in claim 1, further including means for limiting the reciprocating movement of said striker rod in said bore.

* * * * *